United States Patent [19]

Dangerfield et al.

[11] Patent Number: 4,558,783

[45] Date of Patent: Dec. 17, 1985

[54] FOLDER FOR SAMPLER PERFUME VIAL

[75] Inventors: Danny E. Dangerfield, Boones Mill, Va.; James A. Purvis, Indianapolis, Ind.

[73] Assignee: Eli Lilly and Company, Indianapolis, Ind.

[21] Appl. No.: 633,738

[22] Filed: Jul. 23, 1984

[51] Int. Cl.[4] ..... B65D 23/00

[52] U.S. Cl. ..... 206/472; 206/37; 206/38; 206/490

[58] Field of Search ..... 206/472, 459, 37, 38, 206/581, 490, 823; 229/92.8

[56] References Cited

U.S. PATENT DOCUMENTS

| | | | |
|---|---|---|---|
| 307,291 | 10/1884 | Goodbody | 229/92.8 |
| 1,204,584 | 11/1916 | Moreland | 229/92.8 |
| 1,238,177 | 8/1917 | Moreland | 229/92.8 |
| 1,602,440 | 10/1926 | Lowenthal | 206/490 |
| 2,335,015 | 11/1943 | Lantheavme | 206/438 |
| 2,794,549 | 6/1957 | Feibusch | 206/490 |
| 2,846,766 | 8/1958 | Harter | 206/37 |
| 3,307,281 | 3/1967 | Mateo | 229/92.8 |
| 3,458,034 | 7/1969 | Larson | 229/92.8 |
| 4,430,843 | 2/1984 | Farale | 229/92.8 |
| 4,471,874 | 9/1984 | Morane | 206/581 |
| 4,496,051 | 1/1985 | Ortner | 206/38 |

FOREIGN PATENT DOCUMENTS

| | | | |
|---|---|---|---|
| 1111787 | 3/1956 | France | 229/92.8 |
| 76486 | 9/1961 | France | 229/92.8 |
| 1407245 | 6/1965 | France | 206/38 |
| 2422559 | 12/1979 | France | 229/92.8 |
| 295092 | 2/1954 | Switzerland | 229/92.8 |
| 398562 | 9/1933 | United Kingdom | 206/385 |

*Primary Examiner*—William T. Dixson, Jr.
*Assistant Examiner*—Brenda J. Ehrhardt
*Attorney, Agent, or Firm*—Houston L. Swenson; Arthur R. Whale

[57] ABSTRACT

A folder for a sampler perfume vial is provided in which the front and back panels of flexible sheet material having cutouts extending to their distal edges are folded to effect a gripping relationship with a protuberance on the vial.

5 Claims, 7 Drawing Figures

FOLDER FOR SAMPLER PERFUME VIAL

BRIEF SUMMARY

It is a common practice for manufacturers of perfumes to provide small sample sizes of their fragrances for potential customers. One method of packaging sampler sizes of perfumes is to use an elongated vial that contains a very small quantity such as 1/30th of a fluid ounce. The vial is generally formed from glass in order to fully demonstrate the color of the perfume as well as to assure chemical stability of the perfume. The vial is provided with a cap that can be formed from plastic material enabling it to securely seat within the vial by a friction fit.

In many instances such vials are distributed in a package form that comprises a small folder approximately the dimensions of a matchbook folder. In some instances the vials have been cemented within such folders. Vials have also been provided with a fastening or protuberance that can engage an opening formed in a portion of the paperboard folder. Mechanical attachments of this type have experienced accidental dislodgement of the vial from the folder and in some instances, the glass vial has broken, thereby adversely affecting the remaining folders in the carton.

The folder of our invention uses a pair of elongated cutouts on two opposing distal edges of a carton blank. This blank is folded about a conventional vial having a fastening element in the form of a small elongated protuberance. In such a manner, the pair of cutouts engage the protuberance and maintain the vial in a secure manner inside the folder. This design has resulted in an especially safe and permanent arrangement for the vial which can be removed only after the folder is unfolded from the glass vial. Assembly of the vial into the folder is extremely simple and is readily adaptable to automated equipment.

DETAILED DESCRIPTION

Referring to FIGS. 2–7, a conventional perfume sample vial 11 having an elongated body 13 and a cap 14 is illustrated. The vial has a fastening means or protuberance 16 which in the particular embodiment extends from cap 14. However, it should be noted that this protuberance can also extend from body 13. When body 13 is formed from glass and cap 14 is made of a plastic material, it is generally more simple from a production standpoint to position the protuberance on cap 14. Protuberance 16 is spaced from body 13 along a portion of its length. Vials and caps of this design are readily available from a number of container manufacturers.

Figure 1:
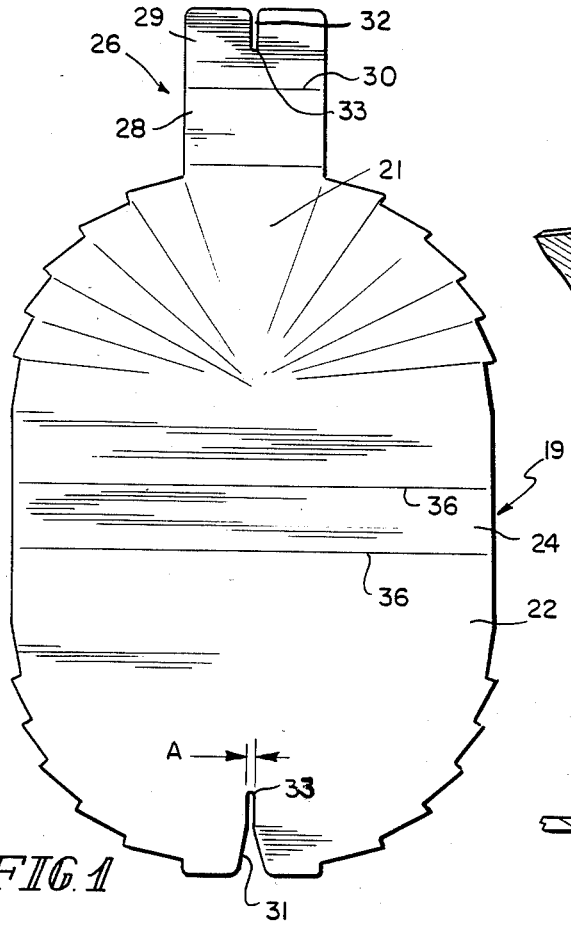
FIG. 1 is a plan view of the paperboard carton blank of this invention.

In FIG. 1, a paperboard blank 19 is illustrated. This blank is a single piece and has a front panel 21 and a back panel 22, which are connected together in the particular embodiment by a bottom end panel 24. Panel 21 is shown in a decorative fan configuration but can be readily formed into other configurations. Extending from front panel 21 which has a decorative fan configuration is a top end panel 26 having a first section 28 and a second section 29 connected thereto by a crease line 30. A pair of elongated cutouts 31 and 32 are provided at the distal edges of back panel 22 and top end panel 26. In the preferred embodiment, each of these cutouts is formed with an initial portion that is substantially wider than the balance of the cutout in order that protuberance 16 of vial 11 can be easily inserted.

Figure 2:
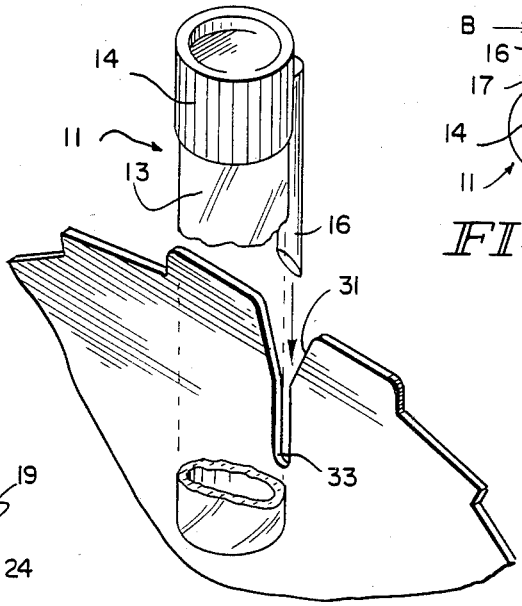
FIG. 2 is a perspective view of a vial with a section removed to illustrate a complementary engaging portion of the carton of FIG. 1.
Figure 3:
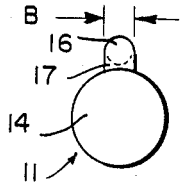
FIG. 3 is a top view of the vial of FIG. 2.
Figure 7:
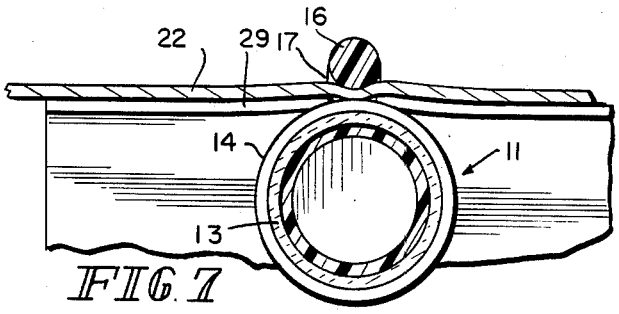
FIG. 7 is a sectional view taken along line 7—7 of FIG. 6.
Figure 4:
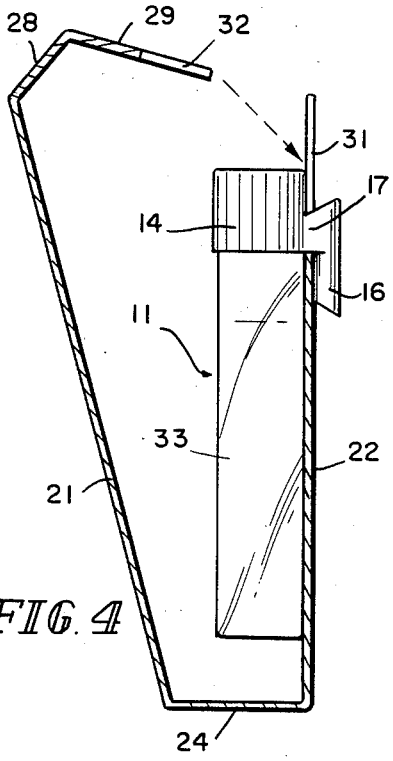
FIGS. 4 and 5 are transverse sectional views of the carton being assembled with the vial.
Figure 5:
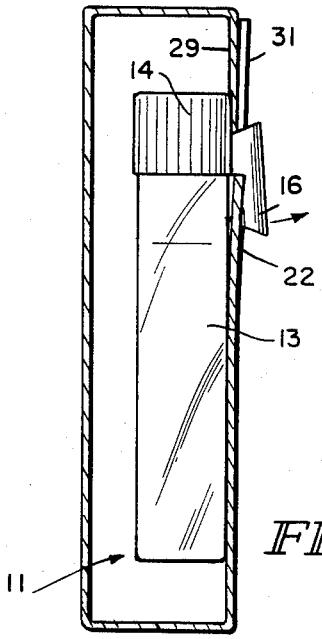
Figure 6:
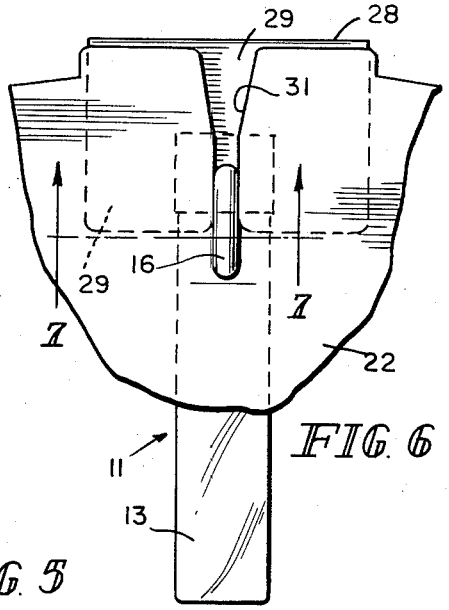
FIG. 6 is an enlarged partial front view of FIG. 5.

To assemble vial 11 into the folder 19, protuberance 16 of the vial is first hooked onto the back panel 22 of the folder by cutout 31 (FIG. 2). This cutout has a width "A" that is approximately equal to the width "B" of protuberance 16 and its connecting portion 17 (FIGS. 1 and 3). Since protuberance 16 is spaced from vial 13, the thin paperboard panel can be readily inserted to the point where the protuberance is hooked at the more narrow inner end 33 of cutout 31. The folder is then bent along the crease lines 36 defining bottom panel 24, whereby section 29 is bent down to cause engagement of cutout 32 with protuberance 16 at its point of connection 17 to cap 14 (FIG. 4). FIGS. 5–7 illustrate the capturing of protuberance 16 by cutouts 31 and 32. Because cutout 31 is narrow at its end 33, it is in tight gripping relationship with protuberance 16. Consequently, vial 11 and protuberance 16 are kept in a position substantially coaxial with the longitudinal axis of blank 19 and cutout 32. This permits ready entry of protuberance 16 into cutout 32 on section 29.

FIGS. 5–7 illustrate the several mechanical forces acting on the vial and carton as a result of cutouts 32 and 33. The narrow ends 33 which straddle connection 17 of the protuberance create a compressive gripping force. The positioning of panel section 29 and its cutout 32 between panel 22 and cap 14 creates a wedging action. FIG. 5 illustrates how this wedging action slightly deflects protuberance 16. The resiliency of connection 17 causes the protuberance to resist this deflection, resulting in a compressive force exerted on panel 22 (FIG. 7).

Vial 11 is now sandwiched within the folder 19 and cannot be accidentally dislodged as long as section 29 of the top end panel 26 engages with protuberance 16. For removal of the vial, panel 26 is pulled upwardly to disengage its grip on protuberance 16. The vial 11 can then be pulled upwardly to remove it from the cutout 31.

We claim:

1. In combination with a vial having an elongated protuberance extending from the vial in spaced relationship, a folder formed from flexible sheet material and comprising a front panel connected at a bottom edge to a back panel, said front panel connected at a top edge to a top end panel having a retaining section with a cutout extending to its distal edge, said back panel having a cutout extending to its distal edge, said folder being folded to position said front and back panels on opposite sides of said vial and said cutouts in gripping relationship with said protuberance.

2. The combination in accordance with claim 1 in which each of said cutouts has a narrow portion with a width substantially equal to the width of the vials protuberance.

3. The combination in accordance with claim 2 in which each cutout has an initial portion substantially wider than the width of the vial's protuberance.

4. The combination in accordance with claim 3 in which the distal edges of said front and back panels overlap each other between the vial and its spaced protuberance.

5. The combination in accordance with claim 4 in which said overlapping distal edges exert a wedging action on the vial's protuberance.

* * * * *